United States Patent [19]

Oldemeyer et al.

[11] Patent Number: 4,670,302

[45] Date of Patent: Jun. 2, 1987

[54] PROCESS AND CONTRIVANCE FOR WETTING POURABLE SOLID MATTER

[76] Inventors: Wilhelm Oldemeyer, 4790, Paderborn-Elsen; Franz-Josef Stelte, 4793, Büren-Ahden, both of Fed. Rep. of Germany

[21] Appl. No.: 658,286

[22] Filed: Oct. 5, 1984

[30] Foreign Application Priority Data

Oct. 8, 1983 [DE] Fed. Rep. of Germany ..... 3336665

[51] Int. Cl.[4] ..... B05B 17/00; B05C 5/00; B05C 11/00; B05D 7/00

[52] U.S. Cl. ..... 427/212; 118/303; 118/315; 118/679; 118/684

[58] Field of Search ..... 118/303, 305, 313, 314, 118/315, 679, 684; 427/212, 424, 425, 426

[56] References Cited

U.S. PATENT DOCUMENTS

| | | | |
|---|---|---|---|
| 4,006,706 | 2/1977 | Lodige et al. | 118/303 |
| 4,370,945 | 2/1983 | Beckschulte et al. | 118/303 |
| 4,510,184 | 4/1985 | Winkler et al. | 118/303 X |
| 4,516,524 | 5/1985 | McClellan et al. | 118/303 X |

FOREIGN PATENT DOCUMENTS

| | | |
|---|---|---|
| 1796280 | 11/1972 | Fed. Rep. of Germany . |
| 2523636 | 12/1976 | Fed. Rep. of Germany . |

*Primary Examiner*—Michael R. Lusignan

*Attorney, Agent, or Firm*—Merchant, Gould, Smith, Edell, Welter & Schmidt

[57] ABSTRACT

Method and apparatus for wetting pourable solid matter. A preferred apparatus includes a tank (31) for accepting the solid matter, a mixing mechanism (32) for moving and breaking up the solid matter within the tank (31), at least one apparatus (5) for spraying the liquid substance supplied from a reservoir (11) into the tank, and an apparatus (2) for continuously feeding solid matter into the tank (31), characterized by the fact that the apparatus for spraying in the liquid substance includes at least one spraying nozzle (5) with an unchangeable (fixed) outlet opening (178) and a closure member (15, 16) that is to be opened (for aerating) and closed continuously, in a controllable sequence, that is connected to a feed line (9) that is under almost uniform pressure, and that is to be opened intermittently, for example electropneumatically, by control signals furnished from the apparatus (2) for supplying the solid matter.

13 Claims, 4 Drawing Figures

PROCESS AND CONTRIVANCE FOR WETTING POURABLE SOLID MATTER

Figure 1:
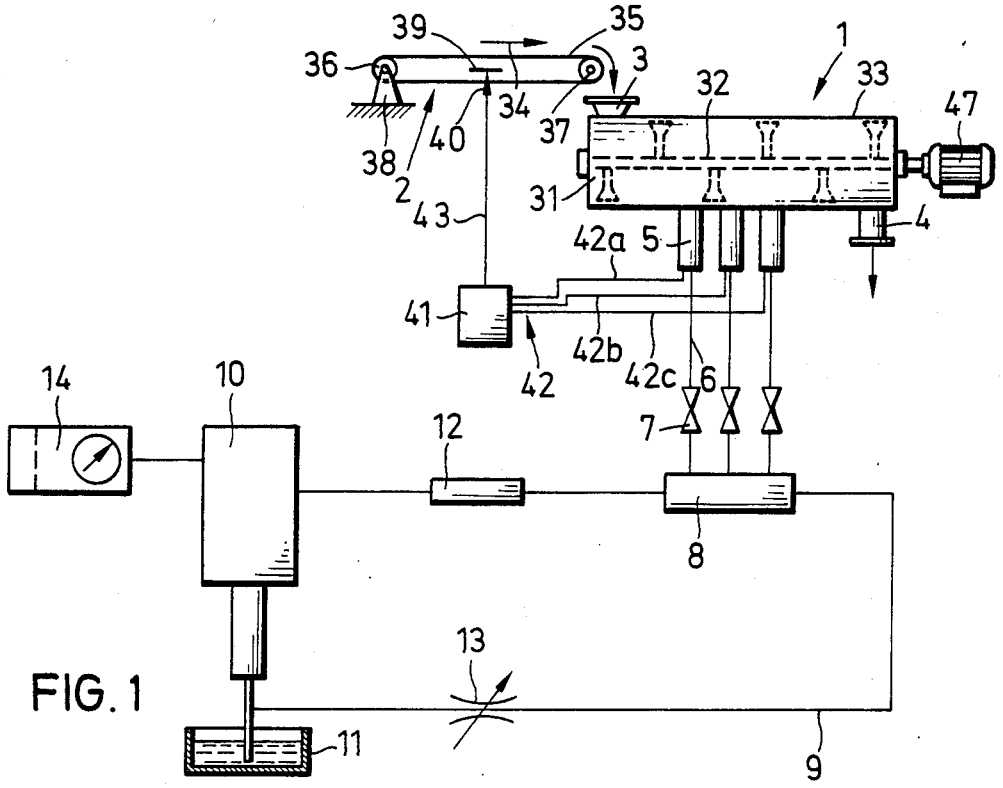

The invention concerns a process for wetting pourable solid matter, for example for covering chips with glue, where a liquid substance under high pressure, dispersed into finest of droplets, is supplied to the solid matter. Additionally, it concerns a contrivance intended for carrying out this process for wetting pourable solid matter, that displays a tank for accepting the solid matter, a mixing (stirring) mechanism for moving and breaking up the solid matter within the tank and at least one apparatus for spraying the liquid substance supplied from a reservoir.

Glue is sprayed under high pressure onto chips whenever it is desired to achieve an airless dispersion of glue, i.e. when a two-substance system is not desired. The airless dispersion of glue has various advantages. Avoided in this fashion are glue mists that appear in the case of a two-substance system of air and glue and that leads to strong contamination (soiling) of the machines in which the chips are covered with glue. Also, glue mists are damaging to the health of the machine operating personnel. Therefore, isocyanates should, for example, not be processed at all in two-substance systems.

However, it is only in more recent times that demand has been made that glue resins be added as the glue for batches of chips for the manufacture of chip boards capable of being used for residences, in particular diphenylmethandiisocyanate (MDI). These types of glue, when they have solidified, are indeed not damaging to health, however, during processing, in particular in the case of spraying, they do develop noxious (poisonous) aerosols that should not reach the environment. Because of the high costs of isocyanate glues, it is, however, of interest to spray them in order to guarantee an economical usage.

It has been shown that one can possibly disperse the substance to be sprayed, such as glue, more finely, and thereby reduce the glue requirement, through means of a single-substance high pressure system than with a two-substance system.

It is known how to spray liquids under high pressure, and this is utilized industrially. To guarantee uniform spraying, the liquid to be sprayed is supplied to the spraying apparatus in a constant amount, as such is the case, for example, when painting. However, it becomes problematic when the amount of substance to be sprayed must be changed during the course of operation, possibly as a consequent magnitude of another magnitude that is changing. This is, for example, the case when covering chips with glue if the chips to be covered with glue do not accumulate in uniform amounts. The weight of the chip amount being supplied to a contrivance for covering with glue is the deciding, leading magnitude for covering with glue, while the amount of sprayed on, flowable substance, and/or of the glue, forms a consequent magnitude because the glue must be metered to the chips in a fixed ratio.

In the case of known chip glue-covering systems, the weight of the chip amount being supplied without interruptions can not be maintained constant. On the other hand, the outlet openings of the nozzles provided for discharging the glue onto the chip amount usually have an unchangeable (fixed) diameter. Therefore, with variations of amount and/or of weight of the chips being supplied, the amount of glue added must likewise be changed. With known type nozzles, this is possible only by changing the pressure under which the glue is being supplied. Variations in pressure of the glue being supplied, however, occassion changes of the spray configuration of the nozzles, whereby, in the extreme case with too low pressure, the glue is no longer sprayed at all, running rather in the form of stream, while in the case of especially high pressure, a finest dispersion of the glue results. Changes in the spray configuration of the nozzles are undesirable in the operation because no uniform wetting and, in particular, no uniform covering of the chips with glue is to be achieved with such changes, even when the ratio between the quantity of chips being fed in and the amount of glue being added, and the weight of the chips and the weight of the glue, respectively, are held constant.

The task underlying the invention, in the case of wetting pourable solid matter with the aid of a liquid substance supplied under pressure for the purpose of maintaining a constant quantity ratio between solid matter and sprayed-on liquid substance, is to be able to maintain the pressure with which the liquid substance is supplied essentially constant.

In accordance with the invention, this task, in the case of a process of the initially mentioned species, is resolved by the fact that the liquid substance is intermittently sprayed into the batch of solid matter under essentially constant pressure.

In contrast to the previously usual wetting and/or covering over of pourable products with glue, such as chips, in accordance with the invention the liquid substance to be sprayed is not constantly supplied along with the fluctuating pressure that is adapting itself to the accummulating chip amounts, but rather in pulsing fashion whereby the length of the individual pulses and/or their time interval determines and/or regulates the amount of the liquid substance supplied and sprayed. If large amounts of liquid substance are required, the pulses for supplying the liquid are longer than the pause times, or the interval between the individual pulses decreases, while in the case of dropping liquid requirement the pulse length drops and/or the interval between successive pulses increases. In this manner, in spite of the fluctuating amounts of liquid substance being supplied, the spray configuration of the nozzles remains constant because the liquid substance is constantly being supplied and sprayed intervalwise under approximately constant pressure.

If an isocyanate base glue resin is used for wetting the chips, it is possible to obtain an economical usage because the finely dispersed glue reacting with the moisture, like the moisture contained in the wood chips, does not "pound away" in the chips, remaining rather on their surface and its adhesive action can therefore develop completely. However, since a single-substance spraying takes place, arising within the tank are health-damaging isocyanate aerosols which, when processed with excessive air, exit from the tank therewith and would load the environment.

The intermittent supplying and spraying of a liquid substance preferentially occurs at a predetermined pulsing rate. In doing this, it is especially advantageous, for the purpose of regulating the amount of liquid substance to be sprayed, to vary the length of the spraying pulse within a constant pulse rate, which can be achieved without problems with electronic control. However, it is also possible to change the pulse rate itself for the purpose of regulating the amount of liquid substance to be sprayed. Finally, also conceivable is changing both the pulse duration (width) and the pulse rate for control if the one or the other method of regulation is in itself insufficient.

Furthermore, the task for the invention is resolved with a contrivance of the initially mentioned species, wherein the mechanism for spraying in the liquid substance is at least one spray nozzle with unchangeable (fixed) outlet opening, and/or with a fixed cross section for the outlet opening, that contains a closure member that is to be opened and closed constantly in a controllable sequence.

Therefore, for spraying in the liquid substance, and in particular the glue, in adjustable amounts, used are not nozzle with changeable outlet opening, but rather spray nozzles with unchangeable outlet opening that are opened and closed intervalwise, so that the flowable substance is not sprayed in continuously, but rather adjustably in an interrupted sequence. It has been shown that the pause times provided between the individual spraying pulses do not evoke any nonuniform wetting of the solid matter, which is to be ascribed back to the fact that the length of the pause times, in relationship to the throughput velocity of the solid matter to be sprayed and/or to be wetted, is very small.

The spray nozzles provided in accordance with the invention can be structured as spray guns known per se, i.e. contain a piston-form or needle-form closure member that cooperates with the inside end of the outlet opening of the spray nozzle.

For controlling the spraying pulse, according to another feature of the invention the closure member of each spraying nozzle is connected with a positioning cylinder that is to be actuated in controllable fashion, which, for example, can be connected to a compressed air line while a return spring is provided that presses the closure member of the spraying nozzle into its closure position. For opening the individual spray nozzles, the positioning cylinder of same is acted upon with compressed air in order to aerate the closure member from its seat at the back end of the nozzle opening, while the closure movements are generated by the return spring, that pushes the closure member into the closure position when the positioning cylinder has been relieved of pressure.

For controlling compressed air feed to the positioning cylinders, provided in the compressed air line of the positioning cylinders is a check valve that is to be opened and closed in controllable fashion.

The spray nozzles of the contrivance are constantly connected to a high pressure line for the liquid substance that is to be sprayed out, with the liquid substance that is under constant pressure being circulated through this high pressure line. Here, we are dealing with a closed system, out from which the liquid substance can exit only in targeted and controlled fashion, namely through the spraying nozzles. The spraying nozzles are, for example, connected to a manifold located in the high pressure line.

Control of the adjustable ratio between opening and closing times of the spraying nozzles is taken over by an electronic circuit, proportionally to the amount of the pourable product that is supplied over a weighing system. The weighing system can include a belt scale, a poured stream meter or a similar mechanism as the transmitter for the control signal. Correspondingly, the liquid substance is added in in relationship to the amount of solid matter measured and/or weighed with the weighing system. Since the amount of solid matter itself is, according to experience, not constant with continuous supply, the addition of the liquid substance can be controlled such that the ratio between solid matter and liquid substance is continually constant.

Because the liquid substance is sprayed with constant pressure, it also is continually dispersed uniformly in finest of droplets and, correspondingly, distributed uniformly over the pourable solid matter.

The pressure of the liquid substance in the wetting system is built up by a pump, such as a gear pump or a piston pump, up to a predetermined value and held at this value. Upon opening the spraying nozzles, the full pressure is immediately available for spraying the liquid substance and remains unchanged until the spraying nozzles again close. The spraying configuration of each individual spraying nozzle is, therefore, always the same during the opening times of these latter and, indeed, independently of the throughput of the liquid substance to be sprayed. The spraying configuration is also the same from beginning to end of each opening interval, independently of how long are the individual opening times of the spraying nozzles and/or pulse times of supply.

It is particularly advantageous if the spraying nozzles project into the tank with changeable length. In this manner, it is possible to allow the spray nozzles to open out in a material to be wetted that is located inside the tank, so that the liquid substance is not sprayed onto the surface of a batch of solid matter, being rather sprayed into this batch. The solid matter batch is, so to speak, broken up ahead of the outlet openings of the spraying nozzles during the pulsiform admixing times of the liquid substance, because of the spraying pressure, so that there results a particularly good and uniform distribution of solid matter and liquid substance which, in the case of spraying the liquid substance onto the surface of a batch of solid matter,would not be capable of being achieved. In the extreme case, the spraying nozzles open out immediately at the wall of the tank, inside of same.

Figure 2:
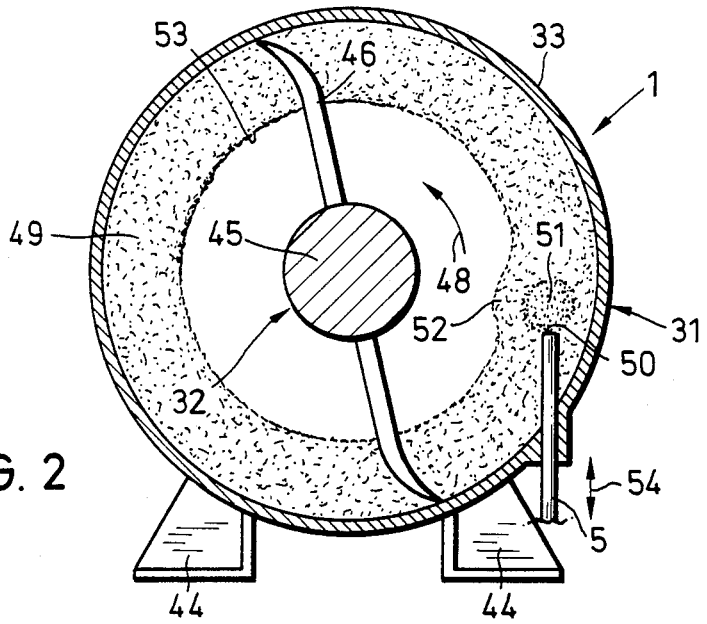
Figure 3:
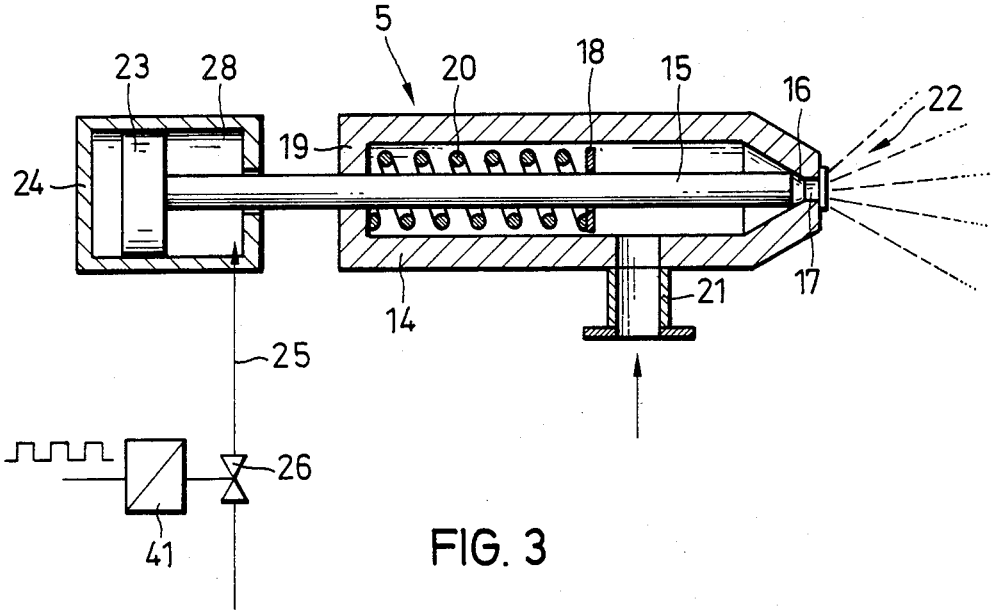
Figure 4:
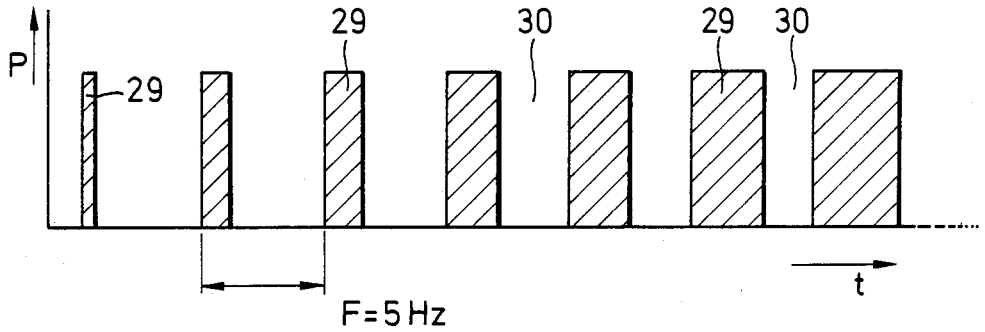

The invention will be explained in more detail with the aid of the drawing and one example of embodiment for covering wood chips with glue, and actually shown are:

FIG. 1 a connection diagram of an installation suitable for carrying out the process in accordance with the invention, FIG. 2 a cross section of the system tank in which the pourable solid matter is wetted with the liquid substance, FIG. 3 a schematic representation of one form of embodiment of an electropneumatically controlled spraying nozzle, in longitudinal cut and, FIG. 4 a control diagram which, with a pulse rate of 5 Hz, shows how the length of the spraying pulse times may be increased relative to the length of the pause times.

The installation (system) illustrated in FIG. 1 serves for covering chip material with glue, for example with an isocyanate base glue resin. The chip material is continually fed into a closed, cylindrical tank 31 of a glue covering machine 1, over a belt scale 2. The tank 31 contains a rotatably journalled mixing mechanism 32 that rolls the chip material that has been fed in and, additionally, transports it from an inlet 3 at one end of the tank 31 to an outlet 4 at the opposite end of the tank.

The tank 31 of the glue covering machine is provided with spraying nozzles 5 that are mounted on the cylindrical wall 33 of the tank of the glue covering machine 1, and open out into the tank 31. Connected at each spraying nozzle 5 is a feed line 6 for liquid glue that is under pressure. Shown in FIG. 1 are three spraying nozzles 5, however, the glue covering machine 1 is generally equipped with more spraying nozzles, for example with a total of twelve spraying nozzles.

Each feed line 6 contains, as an example, a check valve 7 to be actuated manually and is connected to a common manifold 8 provided for all spraying nozzles 5.

The manifold 8 is in a line 9, for example a hose line, wherethrough liquid glue under high pressure is fed forward and, thereby, rolled about.

The glue is taken out from a reservoir 11 with a high pressure pump 10 and conveyed at the desired pressure to the manifold 8, through a double (dual) filter 12 disposed in the line 9. The glue that is not fed from there to the spraying nozzles 5 flows further in the line 9 and back to the reservoir 11 through a control valve 13, so that no glue can solidify and set in the conduit system. If a piston pump is used, associated with the high pressure pump 10 is a servicing unit 14.

The belt scale 2 consists of an endless conveyor belt 35 capable of being driven in the direction of an arrow 34, said conveyor belt running over end-located guide rollers 36 and 37. The guide roller 36 is illustrated supported on a fixed bearing 38. The guide roller 37 is journalled in the same fashion, however its bearing has been left out for the purpose of simplifying the sketched representation in FIG. 1. The pourable material transported over the conveyor belt 35 is poured into the inlet 3 of the tank 31.

The belt scale 2 furnishes, by means of a measurement strip 39 and a transmitter 40, control signals to an electronic control unit 41 that serves for controlling the spraying nozzles 5 and is connected therewith via an electronic line 42 and individual lines **42*a*, 42*b* 42*c*, respectively. The transmitter 40 is connected with the control unit 41 via an electric line 43**.

To be recognized in FIG. 2 is that the tank 31 of the glue covering machine 1 is structured cylindrically and stands on feet 44. Rotatably journalled at the center of the tank 31 is a shaft 45 of the mixing mechanism 32, to which are attached, over the circumference and length, helicoidally distributed stirring tools 46 that reach near to the cylindrical wall 33 of the tank 31. When the shaft 45 of a motor 47 (FIG. 1) is driven at a sufficiently high speed in the direction of an arrow 48, the pourable material located inside the tank 31 forms a ring of material 49 that wanders along the wall 33 of the tank 31, over a helicoidal path, from inlet 3 to outlet 4.

Also to be recognized from FIG. 2 is that the spraying nozzles 5 project eccentrically into the tank 31 and, in so doing, open out inside the ring of material 49, so that the glue supplied through the individual spraying nozzles 5 is sprayed into the ring of material 49. Ahead of the opening 50 of each spraying nozzle 5, formed during the spraying pulse times, in each case, is a broken up zone 51 in the ring of material 49, in which the solid matter particles of the ring of material are intensively and uniformly mixed with the fine droplets of glue, into which the glue supplied through the spraying nozzles 5 has been dispersed. Zone 51 can be demarcated by a buckling 52 on the inside 53 of the ring of material 49. The direction of rotation of the shaft 45 is selected such that the stirring tools 46 of the spraying mechanism of the spraying nozzles 5 do not counteract and, correspondingly, do not compress the broken up zones 51.

The spraying nozzles 5 are displaceable in their axial direction and adjustably journalled in the wall 33 of the tank 31, as is indicated by a double arrow 54. In this fashion, their opening 50 can project to a different measure into the tank 31 and, therewith, to a different depth in the ring of material 49. In the extreme case, the opening 50 can also lie on the wall 33 of the tank 31.

To be recognized from FIG. 3 is that each spraying nozzle 5 displays a housing 14 with a piston rod 15 journalled in axially displaceable fashion therein, whose pointed outer end 16 cooperates with the inner edge of a nozzle opening 17. Disposed on the piston rod 15, between a shoulder 18 and the back wall 19 of the housing 14, is a helical spring 20 that presses the piston rod 15 in the direction toward the nozzle opening 17, so that the pointed, forward end 16 of the piston rod 15 normally lies, in sealing fashion, against the inner end of the nozzle opening 17.

Leading into the housing 14 is an inlet stub 21 that is connected to the tie line 6 of the corresponding spraying nozzle and, therewith, to the manifold 8 of line 9, so that glue under high pressure is introduced through the inlet stub 21 into the housing 14, said glue being sprayed out from the nozzle opening 17 when the pointed end 16 of the piston rod 15 is aerated by the nozzle opening 17. The glue is then sprayed out from spraying nozzle 5, dispersed in finest of droplets, in the form of a cone spray 22, provided that the material ring 49, not illustrated in FIG. 3, does not influence the shape of the cone spray.

Mounted at the back end of the piston rod 15 is a piston 23 that is displaceably disposed inside a positioning cylinder 24. Opening out into the forward end of the positioning cylinder 24 is a compressed air line 25 that contains a check valve 26. This check valve 26 is connected with the control unit 41, which opens the check valve 26 as soon as the spraying nozzle 5 is to spray glue into the tank 31.

Then, piston 23 is pushed—toward the left as seen in FIG. 3—by the compressed air introduced into the pressure chamber 28, whereby the pointed end 16 of the piston rod 15 is aerated by the nozzle opening 17 and, accordingly, the glue that is under high pressure can come out of the nozzle opening 17.

If the check valve 26 is opened, the pressure chamber 28 is aerated via the closed check valve, so that the return spring 20 pushes the piston rod 15 back toward the nozzle opening 17, whereby this latter is closed and no more glue can come out.

The control unit 41 operates electronically at a predetermined frequency (rate), whereby, however, the pulse lengths of the opening times of the check valve 26 are capable of being changed within the preselected rate in accordance with control signals furnished by the belt scale 2, as shown in FIG. 3.

Capable of being recognized from the diagram in accordance with Fig. 4 is that, with constant rate, the length of the pulse times 29 during which glue is being sprayed, and the length of the intermediately located pause times 30 during which the spraying nozzles 5 are closed, is variable. In each case, provided between the pulse times 29 is a pause time 30. The pressure that is available for spraying out the glue is practically the same during all pulse times 29, independently of how long the individual pulse times are.

If a piston pump is used for generating pressure, the conveying pressure of the glue can be maintained practically constant. However, also capable of being used are pumps that deliver an essentially same working pressure.

SUMMARY

Proposed for high pressure spraying of liquid substances such as glue is to spray the liquid substance under constant pressure, intervalwise, so that there results a control of the sprayed amount by altering the spraying pulse times, without having to change the pressure under which spraying is being done. This type of spraying is particularly suited for glueing chip products with glues which, in the case of inexpert processing, can form aerosols that are damaging to health.

We claim:

1. A process for wetting pourable solid matter, wherein a liquid substance under high pressure, dispersed into the finest of droplets, is supplied to the solid matter, characterized by the fact that the liquid substance is intermittently sprayed into a batch of the solid matter under essentially constant pressure wherein the liquid substance is pulsed on and off and the length of individual pulses and their rate determines the amount of liquid substance sprayed.

2. The process according to claim 1, characterized by the fact that the liquid substance is sprayed intermittently into the batch of solid matter at a predetermined pulsing rate.

3. The process according to claim 1 or 2, characterized by the fact that, for regulating the amount of liquid substance to be sprayed, the length of the pulses, within a constant pulsing rate, is changed.

4. The process according to claim 1 or 2, characterized by the fact that the pulsing rate is changed for regulating the amount of liquid substance to be sprayed.

5. An apparatus for wetting pourable solid matter with a liquid substance, comprising a tank for accepting the solid matter, a mixing mechanism for moving and breaking up the solid matter within the tank, a reservoir suitable for containing the liquid substance, at least one apparatus for spraying the liquid substance supplied from the reservoir into the tank, and an apparatus for continuously feeding solid matter into the tank, characterized by the fact that the apparatus for spraying in the liquid substance comprises at least one spraying nozzle with an unchangeable outlet opening and a closure member that is to be opened and closed continuously, in a controllable sequence, that is connected to a feed line that is under almost uniform pressure, and that is to be opened intermittently by control signals furnished from the apparatus for supplying the solid matter.

6. The apparatus according to claim 5, characterized by the fact that the spraying nozzles are spray guns, and that closure member of each spraying nozzle is connected with a positioning cylinder capable of being actuated in controllable fashion.

7. The apparatus according to claim 6, characterized by the fact that the positioning cylinder is connected to a compressed air line that contains a check valve that is to be opened and closed in controllable fashion, and that a return spring is provided that presses the closure member into its closure position.

8. The apparatus according to one of claim 5 to 7, characterized by the fact that the spraying nozzles are constantly connected to a high pressure line through which the liquid substance that is under essentially constant pressure circulates.

9. The apparatus according to claim 8, characterized by the fact that the spraying nozzles are capable of being connected to a manifold located in the high pressure line.

10. The apparatus according to one of claim 5 to 9, characterized by the fact that the spraying nozzles penetrate, with adjustable length, into the tank through openings in the tank wall.

11. The apparatus according to one of claims 5 to 10, characterized by the fact that the spraying nozzles are capable of being controlled by means of monitoring the differential pressure in their feed lines.

12. The process according to claim 1, wherein the pourable solid matter comprises wood chips and the liquid substance comprises glue suitable for cohering the wood chips together.

13. The apparatus of claim 5, further comprising electropneumatic means for intermittently opening the closure member.

* * * * *

UNITED STATES PATENT AND TRADEMARK OFFICE

CERTIFICATE OF CORRECTION

PATENT NO. : 4,670,302

DATED : June 2, 1987

INVENTOR(S) : WILHELM OLDEMEYER

It is certified that error appears in the above-identified patent and that said Letters Patent is hereby corrected as shown below:

Column 3, line 67, for "in in relationship" read --in relationship--.
Column 8, line 11, for "that closure" read --that the closure--.
Column 8, line 20, for "claim" read --claims--.
Column 8, line 30, for "claim" read --claims--.

Signed and Sealed this

Nineteenth Day of January, 1988

*Attest:*

DONALD J. QUIGG

*Attesting Officer*

*Commissioner of Patents and Trademarks*